United States Patent [19]

Larsson et al.

[11] 4,115,217

[45] Sep. 19, 1978

[54] PROCESS FOR ELECTROLYTIC PREPARATION OF CHLORITES

[75] Inventors: Karl-Georg Larsson, Trollhättan; Maria Norell, Ljungaverk, both of Sweden

[73] Assignees: Kemanord AB, Stockholm 11, Sweden; Kemanord AB, Stockholm 11, Sweden; Kemanord AB, Stockholm, Sweden

[21] Appl. No.: 794,698

[22] Filed: May 6, 1977

[30] Foreign Application Priority Data

May 11, 1976 [SE] Sweden ..... 7605373

[51] Int. Cl.[2] ..... C25B 1/36; C01B 11/10

[52] U.S. Cl. ..... 204/95; 423/475; 423/479; 423/480

[58] Field of Search ..... 204/95; 423/479, 480, 423/475

[56] References Cited

U.S. PATENT DOCUMENTS

| | | | |
|---|---|---|---|
| 2,584,824 | 2/1952 | Vanharen et al. | 204/95 |
| 3,058,808 | 10/1962 | Ernest | 423/479 |
| 3,107,147 | 10/1963 | Hirschberg | 423/480 |
| 3,347,628 | 10/1967 | Sepall et al. | 423/480 |
| 3,884,777 | 5/1975 | Harke et al. | 204/84 |
| 3,929,974 | 12/1975 | Winfield | 423/478 |
| 3,950,500 | 4/1976 | Jaszka | 423/480 |

FOREIGN PATENT DOCUMENTS

| | | | |
|---|---|---|---|
| 165,085 | 1/1950 | Austria | 423/479 |
| 543,591 | 7/1957 | Canada | 423/480 |

*Primary Examiner*—F.C. Edmundson
*Attorney, Agent, or Firm*—Fred Philpitt; Fred Philpitt; Fred Philpitt

[57] ABSTRACT

This invention relates to a process for the preparation of chlorite from chlorate.

7 Claims, 1 Drawing Figure

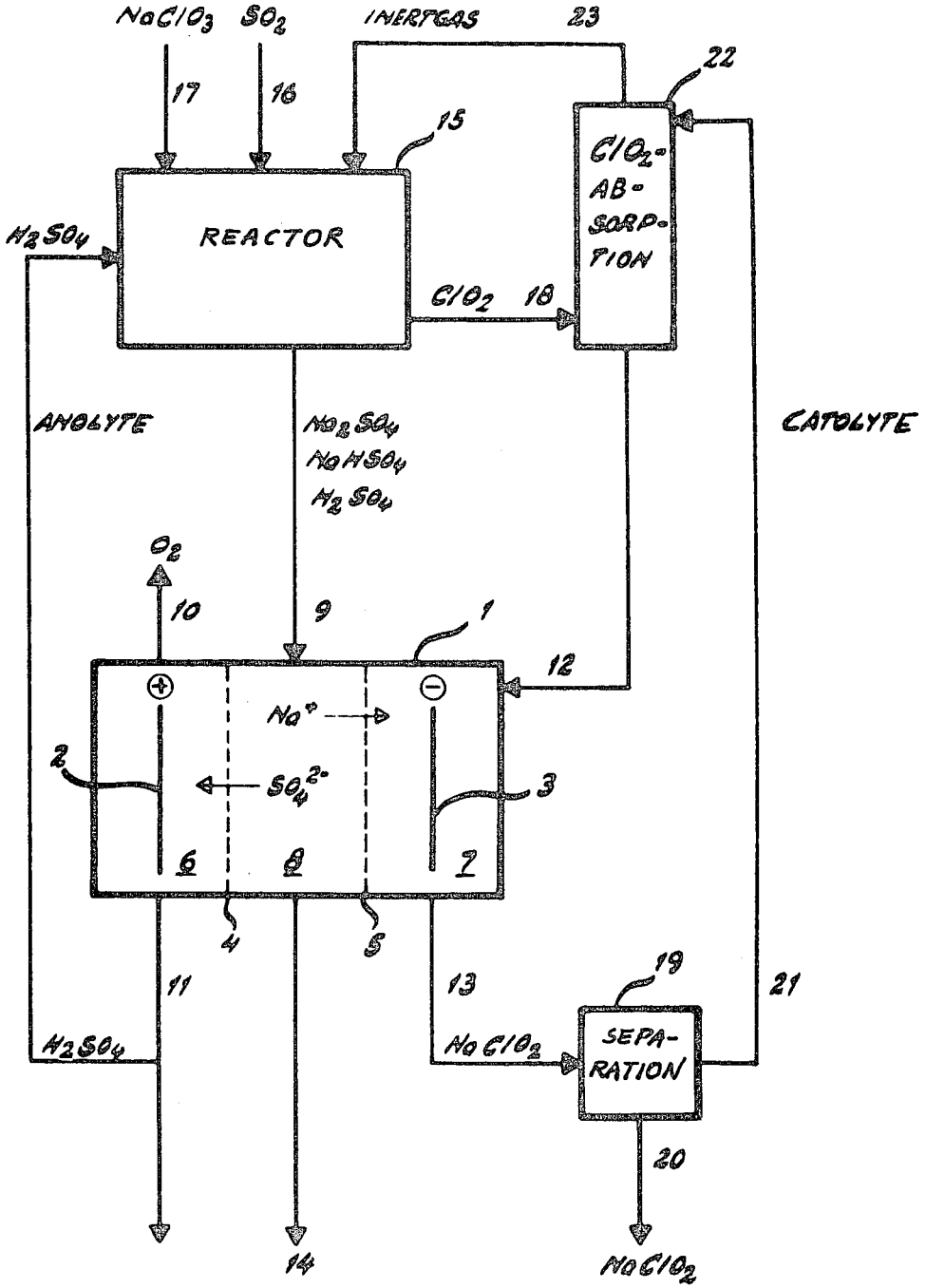
NaClO3
SO2
INERTGAS
23
22
17
16
15
ClO2-AB-SORP-TION
H2SO4
REACTOR
ClO2
18
ANOLYTE
Na2SO4
NaHSO4
H2SO4
CATOLYTE
O2
10
9
1
12
Na+
SO4 2-
2
3
6
8
7
4
5
11
13
19
21
H2SO4
NaClO2
SEPA-RATION
20
14
NaClO2

PROCESS FOR ELECTROLYTIC PREPARATION OF CHLORITES

BACKGROUND

Chlorite (i.e. sodium chlorite) is an oxidation agent, and its most important use is as a bleaching agent, preferably for textiles. Chlorite is also used for the local preparation of small amounts of chlorine dioxide by oxidation with chlorine. Such a product flow of chlorine dioxide is only contaminated by chloride ion and can therefore be used without separation stages for e.g. water purifying.

In spite of trials in other directions almost all chlorite is at present prepared by the chemical reduction of chlorine dioxide. If chlorine dioxide is led into sodium hydroxide, disproportioning takes place and chlorite and chlorate (i.e. sodium chlorate) are formed according to the following formula $$2\ ClO_2 + 2\ NaOH = NaClO_2 + NaClO_3 + H_2O$$

Thus, one mole of chlorite is obtained from two moles of chlorine dioxide. By adding a reducing agent it is theoretically possible to obtain an equimolar amount of chlorite from chlorine dioxide. A plurality of substances have been suggested as reducing agents, such as zinc, hydrogen peroxide, carbon powder, lead(II)oxide and sodium amalgam:

$$2\ ClO_2 + Zn + 2\ NaOH = 2\ NaClO_2 + Zn(OH)_2 \qquad \text{I}$$

$$2\ ClO_2 + H_2O_2 + 2\ NaOH = 2\ NaClO_2 + 0_2 + 2\ H_2O \qquad \text{II}$$

$$4\ ClO_2 + C + 6\ OH^- = 4\ ClO_2^- + CO_3^{2-} + 3\ H_2O \qquad \text{III}$$

$$2\ ClO_2 + PbO + 2\ NaOH = 2\ NaClO_2 + PbO_2 + H_2O \qquad \text{IV}$$

$$ClO_2 + Na_{(Hg)} = NaClO_2 \text{ (see British patent 764,019).} \qquad \text{V}$$

When zinc is used as the reducing agent, zinc hydroxide or zinc carbonate is obtained as a by-product, which must be separated and worked up or deposited.

Hydrogen peroxide is an expensive chemical agent and does not provide any by-product of value at the reduction. Moreover, handling of hydrogen peroxide involves some safety problems. Since oxygen gas is the only by-product obtained, the separation problems are reduced in the working up.

When reducing with carbon an awkward carbon suspension must be handled, and carbonate is obtained as a by-product which must be separated.

The use of lead oxide in reduction will give the technically important chemical $PbO_2$ as a by-product after separation. However, the use of lead in the process creates handling problems due to the toxicity of the substance.

Processes based on sodium amalgam as reducing agent have two disadvantages. Mercury is per se an inconvenient and toxic chemical. Moreover, the sodium content in the amalgam is low, and therefore large amounts of amalgam must be handled.

In all these processes an addition of reducing agent is required and the price of the added chemical decides the economy of the process to a high degree.

Thus, reduction by addition of chemical reducing agents involves a number of disadvantages. Attempts have also been made to prepare chlorite electrolytically. A direct electrolytic oxidation of chloride ion, chlorine or hypochlorite ion to chlorite ion does not seem to be thermodynamically possible, nor direct electrolytic reduction of chlorate to chlorite. British Pat. No. 644,309 discloses a process in which chlorine dioxide is electrolytically reduced to chlorite. In that process the chlorine dioxide is led to the cathode compartment, which is defined from the anode compartment by means of a diaphragm. However, this process has a number of drawbacks. In all of the embodiments according to the above British patent chemicals are required to make possible an anode process as a compliment to the chlorine oxide reduction at the cathode. Either sodium hydroxide, sodium chloride or sodium amalgam is added. Because of these necessary chemical additives the economy of the process is deteriorated, especially since by-products of a great value are not obtained either. As mentioned above, the use of amalgam brings other disadvantages in addition to the price factor. In the case of sodium chloride solution as anolyte it is also especially unfavourable that the cell halves are only separated by a diaphragm, as this means that the catholyte will be mixed with chloride ions, which catalyze a decomposition of chlorite formed.

In addition to the problems mentioned above in the preparation of chlorite by known methods there are additional problems associated with the preparation of the chlorine dioxide used as the starting material for the preparation of chlorite.

As stated above almost all chlorite preparation presently takes place by the reduction of chlorine dioxide. Since this chemical is extremely reactive, explosive and dangerous to the health, the transport thereof involves technical problems that are difficult to overcome. This means that the required chlorine dioxide must be prepared at the place of its reduction to chlorite. The greatest problems associated with the preparation of chlorine dioxide are connected with the working up of the residual solution from the reactor.

Normally chlorine dioxide is prepared by reduction of chlorate, and the most common processes for this can be summarized in the following gross formulas.:

$$NaClO_3 + SO_2 \rightarrow 2\ ClO_2 + Na_2\ So_4$$

(the Mathieson process) VI $$2\ NaClO_3 + CH_3OH + H_2SO_4 \rightarrow 2\ ClO_2 + HCOOH + H_2O + Na_2SO_4$$

(the Solvay process) VII $$NaClO_3 + NaCl + H_2SO_4 \rightarrow ClO_2 + \tfrac{1}{2}\ Cl_2 + H_2O + Na_2SO_4$$

(the Rapson R-2-process, see the Canadian patent 543,589) VIII

Thus, the reducing agent in these processes is sulphur dioxide, methanol and chloride ion respectively. Other reducing agents, such as chromic acid or nitrogen oxides, have also been tried, but principally due to their higher price they have not been commercially utilized to a considerable degree.

All these processes take place with an excess of a strong acid, usually sulphuric acid, and therefore the spent liquor of the reactor will consist of sodium sulphate in strong sulphuric acid.

It is essential from an economical as well as environmental point of view that this liquor can be taken charge of and utilized. Previously it has happened that this liquor has quite simply been disposed of in the seqage system. However, more and more rigorous environmental demands have necessitated great efforts to take care of the spent liquor in another way.

By using a combined reactor/evaporator the sulhuric acid can be retained in the reactor and only solid sodium sulphate be withdrawn i.e. the least possible amount of by-product for this process (the Rapson R-3-process, see the Swedish Pat. No. 312,789).

By replacing the addition of sodium chloride and part of the addition of sulphuric acid with hydrochloric acid, which, however, is a more expensive chemical substance than sulphuric acid, the produced amount of sodium sulphate can be additionally reduced.

However, these processes still produce the difficultly usable sodium sulphate, and therefore it has been suggested to convert this into sodium chloride and sulphuric acid:

$$Na_2SO_4 + 2\ HCl \rightarrow 2\ NaCl + H_2SO_4 \qquad \text{IX}$$

(the Rapson R-4-process)

Thus this process requires another reactor system after the chlorine dioxide reactor to recover sulphuric acid, and then the sodium chloride product is still not made useful.

A similar result, i.e. a sodium chloride containing spent liquor, is obtained if the chlorate reduction is carried out merely with hydrochloric acid:

$$NaClO_3 + 2\ HCl \rightarrow ClO_2 + \tfrac{1}{2}\ Cl_2 + H_2O + NaCl \qquad \text{X}$$

If in this process like in the previous ones one tries to achieve a high degree of conversion of the chlorate by means of a high acid content, some problems with the following side reaction will occur:

$$NaClO_3 + 6\ HCl \rightarrow 3\ Cl_2 + NaCl + 3\ H_2O \qquad \text{XI}$$

(see the Canadian patent specification 920,773)

which will increase with increasing concentration of chloride ion, and partly with the spent liquor, which due to the high price of hydrochloric acid must not go to waste or due to its acidity cannot be economically worked up to chlorate in an electrolytic cell, either, as the solution must first be electrolytically neutralized.

Therefore processes of this kind (see the Swedish Pat. No. 155,759 and 337,007) operate with a low acid content, which permits electrolytic working up of the liquor to chlorate. In return these processes require a long residence time for the reaction between chlorate and hydrochloric acid and, consequently, several and big reactors. A high emperature is also used to increase the conversion rate, which brings increased risks of explosion, the mastering of which requires an increased number of apparatuses and process technical compromises.

Thus, to sum up, both purely chemical working up trials by the addition of reagents as well as working up trials by electrolysis of residual solutions from chlorine dioxide reactors have so far caused problems difficult to solve. Problems have also arisen both in acidification with sulphuric acid and with hydrochloric acid, which acids have so far been predominant.

THE PRESENT INVENTION

The present invention evades the above-mentioned problems and presents a new way for the preparation of chlorite from chlorate. The present invention involves a process in which chlorate is reduced to chlorine dioxide in a reactor, the chlorine dioxide and the residual solution from the reactor being led to an electrolytic cell for electrolytic reduction of the chlorine dioxide to chlorite.

According to a preferred embodiment of the invention the used electrolytic cell contains at least one ion selective membrane.

According to another preferred embodiment of the invention a water decomposition is allowed to take place at the anode, an acid enriched fraction of the electrolyte being withdrawn from the anode and recycled to the chlorine dioxide reactor.

By the process of this invention (1) the difficulties associated with a purely chemical reduction of chlorine dioxide are avoided, (2) the difficulties and the drawbacks of known processes for electrolytic reduction of chlorine dioxide are avoided and (3) the difficulties of handling the residual solution from the chlorine dioxide reactor are avoided by the use of this residual solution as raw material at the electrolytic reduction of the chlorine dioxide to chlorite.

If according to the invention chlorine dioxide and residual solution from the chlorine dioxide reactor are led to an electrolytic cell and the cell voltage is adjusted in a suitable way chlorine dioxide molecules at the cathode will be reduced to chlorite ions according to the general formula:

$$ClO_2 + e^- = ClO_2^- \qquad \text{XII}$$

If suitable cations are present in the electrolyte together with the chlorite ions thus formed, the electrolyte can be withdrawn and chlorite be separated by evaporation and crystallization or in another way. Suitable cations are added to the electrolyte with the residual solution, which contains the cations included in the chlorate added in batches to the chlorine dioxide reactor, usually alkali metal or earth alkali metal cations, preferably sodium ions. Contrary to the known process for electrolytic preparation of chlorite no external chemical need thus be added as cation source in the process of the invention, but the residual solution formed in the process may be this source, it also being gained that a working up of the residual solution is achieved. The cations migrate in the electric field towards the cathode, where they constitute the separable chlorite product together with chlorite ions formed at the cathode.

Since in principle the only thing required to establish the process outlined above is that a sufficient chlorine dioxide concentration is maintained at the cathode and that the necessary cations accompany the residual solution to the electrolytic vessel, this basic reaction an be brought about within wide variation limits of the other process conditions.

Therefore, our invention will provide e.g. option in respect of the acid content in the reactor and the acid used. Thus, this need not be either sulphuric acid or hydrochloric acid, and other acids can be selected. Also mixtures of acids are permissible. For the same reason the reducing agent used can be chosen very freely and the choice need not be restricted to the agents so far used. Nor is it necessary that the reduction to chlorine dioxide be carried out by addition of a chemical reducing agent, but our invention is useful for a possible electrolytic reduction of the chlorate. Through our invention there is also a freedom of choice concerning type of reactor, temperature, concentrations and end products. The content of chloride ion may e.g. without detriment to the electrolytic process be maintained on a low level to avoid the side reaction that was discussed above in connection with the hydrochloric acid reduction.

As a complement to the chlorine dioxide reduction at the cathode a great number of anode reactions are possible. If the anode reaction is not driven in another direction by a special arrangement of membranes and supply of external chemicals the anode reaction will be defined by the anions present in the electrolyte and by the selected process conditions. As indicated above the anion content of the residual solution mostly consists of sulphate and/or chloride ions. If the residual solution contains chloride ions the process conditions can be adjusted so that development of chlorine gas will occur at the anode, chloride ions being removed from the solution at the same rate as sodium ions in the form of sodium chlorate are withdrawn at the cathode. If the residual solution contains sulphate ions the electrolytic cell can in certain cases be adjusted so that peroxide disulphate ions are formed at the anode, if desired. If other substances are present in the residual solution other products can be obtained at the anode.

Another possibility of anode reaction is to let decomposition of water take place, hydrogen ions being formed in the solution while oxygen gas is released at the anode, if no depolarizing substance such as hyrogen gas is also added at the anode. Together with the anions migrating to the anode the hydrogen ions will form an acid, which in addition to the hydrogen ion enrichment has a minor amount of sodium ions. The enriched acid thus obtained can with advantage be fed back to the chlorine dioxide reactor for repeated use a acidification agent.

This way of preparing an acid by decomposition of water has many advantages. For example, at least part of the acid can always be recycled to the reactor, and in that way the deposit problems for the anode product are reduced simultaneously as the need of an external addition of acid is eliminated. Also, in this way a high degree of option as to the conversion degree of the chlorate in the reactor is achieved, as possibly nonconverted chlorate ions tend to migrate towards the anode region in the following electrolytic process and accompany the acid enriched flow back to the reactor.

In comparison with working of the residual solution to chlorine or peroxide disulphate the advantage is gained that an anode reaction, i.e. water decomposition, is utilized, which requires a lower cell voltage than the other, which means that this reaction can be realized more easily with a high selectivity and means an important advantage with respect to energy economy.

As the decomposition of water in principle only requires the presence of water and a charge carrier at the anode, this reaction can be realized to a high degree independently of the composition as well the concentration of the electrolyte.

In this way a high degree of option is obtained as to the acid content in the reactor, as the decomposition of water by a suitable choice of cell voltage, current density, choice of electrode material, mixing and current conditions at the electrode surface can be made to take place within a very broad spectrum of pH-values, from strongly acidic to alkaline ones. Also, with respect to other reactants in the reactor a high degree of option is obtained, as the decomposition of water can be brought about in the presence of most of the anions possible in the reactor.

The production formed in the decomposition of water, the hydrogen ion, does not cause any extra side reactions of an unforseen nature difficult to master in its interaction with the other substances present in the electrolyte. The effect of the hydrogen ion is in general easy to anticipate and the residual solution contains already from the beginning hydrogen ions.

Even if the reactions and products described above can be obtained in an electrolysis cell lacking membranes or only containing one or more conventional diaphragms, by withdrawal of electrolyte fractions at anode and cathode, it is a preferred embodiment of the present invention that the cell is provided with one or more ion selective membranes. In general the insertion of ion selective membranes is another control means for the reactions in the cell because the ion migration in the cell can be made selective and a possibly added type of ions or their reaction products can be retained within the desired region in the reactor. In the process according to the present invention it is e.g. possible to bring about by means of ion seective membranes anode reactions other than those outlined above.

In addition to the advantage of an increased freedom of choice the ion selection membranes provide several other advantages. In comparison with conventional diaphragms the ion selective membranes are as a rule thinner and allow a more compact cell construction with small spaces between the electrodes, the voltage drop in the electrolyte being reduced with an improved yield of energy as a result. The ion selective membranes prevent the ions formed from migrating back and prevent mixing of the electrolytes in the anode and cathode compartments with non-desired ion types, side reactions being avoided, which results in an improved electron yield. The end products will also be more pure which increases their usefulness. This possibility of pure end products is of special importance when corrosive substances are included in the electrolyte. The residual solutions from chlorine dioxide reactors contain e.g. as a rule chloride ions, and difficult corrosion problems might occur in apparatuses to which a product flow considerably contaminated by these ions is added.

If the cell according to the present invention is equipped with a cation selective membrane the chlorine dioxide is preferably supplied to the cathode compartment and the residual solution to the anode compartment. As ion selective membranes are much tighter to diffusion than diaphrams the chlorine dioxide added to the cathode compartment will be effectively retained there and the desired reduction at the cathode will take place, while the presence of chlorine dioxide at the anode is avoided and consequently undesired oxidaton reactions of the chlorine dioxide. The membrane retains the chlorine dioxide effectively even if the content is kept on a high level to facilitate the reaction and to avoid by-reactions. In order to avoid the disintegration of the chlorine dioxide to chlorate and chlorite one can add minor amounts of hydrogen peroxide in the cathode compartment, and the cation selective membrane contributes also in this case to retaining the substance in the catholyte and to leave the anolyte uninfluenced.

Cations, usually sodium ions and hydrogen ions, will migrate into the catholyte from the residual solution on the other side of the membrane. A certain degree of hydrogen ion migration can be tolerated. However, the migration of hydrogen ions should not be too great as the chlorite formed tends to disintegrate at low pH values. If the residual solution is very acid a certain neutralization thereof or of the catholyte should therefore be carried out at some stage of their treatment, possibly by insertion of another cation selective membrane in addition to the first, between which the neutralization is conducted.

Moreover, the cation selective membrane fulfills the very important function of retaining the chlorite ions formed in the cathode compartment so that these will not migrate towards the anode and be oxidized resulting in a reduced yield. This also prevents undersired types of the ions from diffusing into the catholyte from the anode compartment. e.g. diffused chloride ions may accelerate the aforesaid chlorite disintegration through a catalytic effect.

As mentioned above the residual solution is supplied in the anode compartment on the other side of the cation selective membrane and the desired anode reaction proceeds according to any of the models outlined above. The anions supplied with the residual solution will be prevented from access to the cathode compartment by the cation selective membrane and will be included - unactuated or reacted - in the product flows withdrawn from the anode compartment. In the simplest case from a separation point of view, when the product vanishes in the form of gas, e.g. when the content of anion in the residual solution is chloride ion and the product is gaseous chlorine, the solution is quite simply depleted of its content of ions. In other cases, as in preparation of peracid or acid enrichment in the anode compartment, a product will be present in the anolyte. In these cases there is a hydrogen ion content in the anolyte, which is desired to be retained there, what, however, is difficult to do as the only membrane of the cell lets through cations. Therefore it is preferred according to a special embodiment of the invention that the cell is divided into three compartments by means of an anion selective membrane next to the anode and a cation selective membrane next to the cathode, the chlorine dioxide being supplied to the cathode compartment and the residual solution to the intermediate compartment. In this case the anode process will be improved in so far as the anion content of the residual solution may migrate into the anode compartment and leave a withdrawable intermediate compartment solution depleted of ions, while cations formed or added at the anode cannot leave the anode compartment. At acid enrichment in the anode compartment a pure and highly concentrated acid can be obtained in this way with a high yield of electrons. In preparation of peracid a strong sulphuric acid can be supplied to the anode compartment without detriment to the working of the intermediate compartment or the reduction of the chlorine dioxide at the cathode.

Finally the possibility of inserting in the three-compartment cell discussed above another cation selective membrane between the anion selective membrane and the anode should be pointed out. In this case the anions present in the residual solution will migrate towards the anode as before, pass the anion selective membrane but be prevented from reaching the anode compartment through the cation selective membrane. Thus, the anions will remain between the two membranes while the charge transport is maintained by other ions in the anode compartment. The hydrogen ions produced in the anode compartment will migrate towards the cathode, pass the cation selective membrane but be prevented from further migration through the anion selective membrane. Thus the anions as well as the hydrogen ions will remain between the two membranes and form the withdrawable acid there. In this way the anode compartment will be free of the anions of the residual solution, which can be an advantage if it is desired to add other substances in the anode compartment for other purposes or if it is desired to avoid side reactions to the decomposition of water at the anode, e.g. development of chlorine gas when chloride ions are present in the residual solution.

The constructive design of the cell compartments actuate the composition and quality of the withdrawn product flows. In the case when the cell is completely lacking membranes the product flows should be withdrawn in the neighbourhood of a cathode and an anode at such an adjusted rate that the ions formed in the electrodes substantially accompany the respective product flows and are not considerably mixed with the rest of the electrolyte. Only if this is done product can flows of a different composition be withdrawn which are not mixed with incoming residual solution in too high a degree. Even when the cell is provided with conventional diaphragms it should be designed in known manner and the product flows be withdrawn in such a way that a loss of product ions, mainly chlorite ions, by back migration will not arise. As the cell is provided with ion selective membranes the mixture of the cell compartment solutions is negligible. However, in this case it may be desirable to model the cell compartments in such a way that when passing a solution through the cell compartment a successive depletion and enrichment respectively of ion type is obtained so that the solution will have a continuously changed composition between inlet and outlet. This can be achieved in known manner by providing the cell compartment with such a cross section that a substantially laminar flow without back mixture is obtained.

If e.g. in the cell discussed above, which contains a cation selective membrane, the cell compartments are not designed in that way and the solutions of the cell compartments are instead substantially completely mixed, the product flow from the cathode compartment will contain much of the added chlorine dioxide together with the chlorite formed while the product flow from the anode compartment will be contaminated with incoming residual solution. If the solutions are instead led in a laminar flow through the cell compartments a product flow with a higher ratio of chlorite/chlorine dioxide can be withdrawn from the cathode compartment and a product flow less contaminated by residual solution from the anode compartment.

In a corresponding way the advantage with a laminar percolation is obtained wth the three-compartment cell that the intermediate compartment solution can be almost totally deionized independently of inlet content before it goes to waste.

It is apparent from the above that the basic inventive idea of leading both the chlorine dioxide and the residual solution from the reactor for chlorate reduction to the electrolytic cell for the preparation of chlorite means a series of variation possibilities, which have all in common that no external source for the chlorite cation need be added, as the total process is quite balanced in this respect, that the inconvenient flow of residual solution is taken charge of and integrated in the process and that the advantages of electrolytic preparation of chlorite are utilized.

It is possible within the scope of this basic inventive idea to adapt the electrolytic process to varying processes of chlorate reduction and, consequently, to varying local prerequisites in respect of supply of raw materials, existing plants and the like. It is also possible to adapt the process to varied needs as to products from the anode process and the working up degree of the residual solution as this can be varied from an optional degree of depletion of its ion content to a total working up to clean, saleable product flows or such ones useful in the process and no contaminated residual fraction at all that need be disposed of in the sewage system.

The invention will now be described in connection with the drawing which illustrates the invention as used with a three-compartment cell, where the acid used in the chlorine dioxide reactor is enriched at the anode.

The working-up cell consists of an electrolytic vessel 1, which in the applications according to the figures is of a conventional design but might also be given another geometrical design, e.g. to cause a laminar flow or to prevent back mixing of the product flows when these are withdrawn from a reactor without membranes.

The reference numeral 2 refers to an anode and 3 refers to a cathode, which should be selected considering their resistance to the electrolyte, occurring overpotentials and desired mixing effects. The material of the anode may be a noble metal, a noble metal oxide, graphite, titanium or other suitable material. The material of the cathode may be titanium, platinized titanium, titanium coated wth ruthenium oxide, magnetite, platinum, graphite or another suitable material. The anode and the cathode may be designed as gas electrodes, viz. porous electrodes, making it possible to introduce a depolarizing gas at the cathode, or the anode and cathode may be designed as electrodes through which liquid can pass, e.g. for supply of the chlorine dioxide solution to the cathode compartment.

4 is an anion selective membrane and 5 is a cation selective membrane. In the embodiments according to the drawing not more than two ion selective membranes are utilized in a cell, these being of different ion selectivity, the anion selective membrane defining the anode compartment and the cation selective membrane the cathode compartment. However, more advanced types of cells with more membranes, optionally in another order, are possible in other desired cell processes. The membranes used should be selected with respect to a good selectivity to the included ions, the selectivity to hydrogen and chlorite ions of course being of a special interest for processes according to the drawing. The membranes used may for instance be of the molecular screen type, ion exchange type or possibly salt bridge type, homogeneous or heterogeneous.

An anode compartment is designated by 6, a cathode compartment by 7 and an intermediate compartment by 8. The electrolyte can be pumped around in the compartment with separate pumps for each compartment and be led through only once and then withdrawn.

The supply line for residual solution has the reference numeral 9, while 10 and 11 are outlets for the oxygen gas and the enriched acid respectively withdrawn at the anode and 12 and 13 are the chlorine dioxide inlet and the cathode product line. As mentioned above, other anode processes are possible in which no oxygen gas need be developed. Different supply lines may also be required in other possible cell processes or in the case of using gas electrodes.

The residual flow from the intermediate compartment is designated by 14 and contains substantially only water in an advanced electrolysis.

As no appreciable diffusion of water through the ion selective membranes takes place and no material flow containing water is supplied to the anode compartment, the amount of water required to withdraw an acid with a desired concentration at 11 should be supplied to the anode compartment thorugh a special conduit, e.g. by supply of the whole or part of the flow 14. However, no such conduit has been shown in the drawing in order to not complicate the drawing.

The acid flow 11 is led to the chlorine dioxide reactor 15 together with a flow 16 of reducing agent and a chlorate flow 17. A chlorine dioxide conduit 18 and the conduit 9 for residual solution leads from the reactor. The product flow 13 withdrawn from the cathode compartment contains chlorite in solution. This is led to zone 19 for evaporation and crystallization, extraction or another separation, from which solid chlorite is extracted at 20. The remaining catholyte flow 21 is led to the unit 22 for chlorine dioxide absorption together with the chlorine dioxide flow 18 from the chlorine dioxide reactor. The chlorine dioxide is dissolved in the catholyte, and this solution is led back to the cathode compartment via conduit 12. The content of inert gas in the chlorine dioxide flow 18 is returned to the reactor 15 via conduit 23.

All the conduits can of course, in a known manner, be provided with the necessary valves, discharge and supply lines, supply tanks, control means, etc.

According to a preferred embodiment of the invention the reactor reaction proceeds according to the reaction formula VI above. This process of preparing chlorine dioxide from sulphur dioxide, sulphuric acid and sodium chlorate and a residual spent liquor of sulphuric acid and sodium sulphate and a product of sodium chlorite has a lot of advantages. Sulphur dioxide as well as sulphuric acid are cheap chemicals. Moreover, sulphur dioxide is often produced locally by a number of industries. The sulphur dioxide is oxidized to sulphate and forms no gaseous rest that may accompany the chlorine dioxide product. The sulphur dioxide is completely converted and will cause in comparison with mainly chloride ions minor side reactions impairing the yield, and therefore the contents of acid and sulphur and sulphur dioxide can be kept on a high level without inconventience at the conversion. Nor does the sulphate ion formed cause any side reactions in the chlorate. In comparison with chloride ions the sulphate ion causes much less corrosion in the reactor or electrolytic cell, as well as in the following processes. This means a simplified material choice. In electrolytic working up the resistance of the sulphate ion to oxidation results in that the water decomposition can be easily brought about with a great selectivity. Furthermore, the big sulphate ion is easily retained by membranes.

In the drawing sodium chlorate is supplied to the chlorine dioxide reactor 15 at 17, sulpher dioxide at 16 and sulphuric acid at 11, from which a flow of chlorine dioxide is withdrawn at 18 and a flow of residual solution of sodium sulphate and sulphuric acid at 9, flow 9 being supplied to the electrolytic vessel 1.

By means of an anion selective membrane 4 next to the anode 2 and a cation selective membrane 5 next to the cathode 3 the electrolytic vessel 1 is divided into three compartments, i.e. the anode compartment 6, the cathode compartment 7 and the intermediate compartment 8. The flow 9 of residual solution is led to the intermediate compartment 8 and the chlorine dioxide solution is led to the cathode compartment 7 via the conduit 12.

When voltage is applied to the cell sulphate ions will migrate from the intermediate compartment 8 through the membrane 4 into the anode compartment 6. At the anode water is decomposed, a flow 10 of oxygen gas leaving the vessel, while hydrogen ions remain and form together with the migrated sulphate ions the enriched acid which is withdrawn at 11 and recycled to the reactor 15.

The cations present in the intermediate compartment, mainly sodium and hydrogen ions, migrate through the membrane 5 and form together with the chlorite ions formed at the cathode 3 and the chlorine dioxide solution supplied via conduit 12 the cathode compartment solution, from which a flow 20 of solid sodium chlorite can be precipitated in the crystallization system 19. The exact reaction process at the cathode is not known, but the gross reaction is apparent from formula XII above.

If the reaction is brought so far that no solution contaminated by ions need be withdrawn from the intermediate compartment 8 an amount of sulphuric acid equivalent to the batch amount of sulphur dioxide plus the amount of sulphuric acid present in the residual solution is thus obtained at the anode. As the sulphuric acid in this way (c.f. formula VI) forms sulphuric acid and as only the originally present amount of sulphuric acid need be recirculated to the reactor, a by-product flow of sulphuric acid can be withdrawn for sale or another use as is indicated by the branch pipe on the conduit 11 in the Figure. If the content of hydrogen ions in the residual solution is not too high, a chlorite amount equivalent to the content of sodium ion in the residual solution will be obtained at the cathode. If the content of hydrogen ions in the residual solution is high, on the other hand, it may be necessary to neutralize the catholyte by addition of alkali, as mentioned above. Preferably the pH-value in the residual solution is between 1 and 7, and most preferably between 3 and 7.

Even if the process described above is preferred, it is also possible to utilize the invention in other reactor processes. If the reducing agent consists of the chloride ion and hydrochloric acid, the residual solution will contain sodium chloride and hydrochloric acid and this acid will be concentrated in the anode compartment. The reducing agent chloride ion will form chlorine gas accompanying the flow of chlorine dioxide. If the reducing agent consists of methanol and sulphuric acid, the residual solution will consist of sodium sulphate and sulphuric acid as well as formic acid or formaldehyde, which formaldehyde will pass the intermediate compartment without being influenced while the sulphuric acid is enriched in the anode compartment. In these cases the reacted reducing agent will not form any anion remaining in the residual solution, no excess acid being formed in addition to that required in the reactor, and therefore the whole amount of acid from the anode compartment will preferably be recycled to the reactor.

In case methanol is used as a reducing agent and the residual solution contains formaldehyde it is possible to separate the formaldehyde from the flow 14 coming from the electrolytic cell by means of distillation and then possibly, by addition of hydrogen gas, to reduce the formaldehyde to methanol for repeated use as reducing agent in the reactor.

In the chlorate reduction in the reactor 15 chlorine dioxide is obtained within wide limits of the process conditions. The chlorate content in the reaction solution can vary between 0.05 N and 10 N. The maximum conversion degree of the chlorate is obtained at the maximum values of the acid content, but the resulting residual solution from the reactor will then also be very acid. To avoid a more comprehensive neutralization of the residual solution in the process of the present invention a lower content of acid is preferred. The lower conversion degree of the chlorate will then not deterioate the process economy to any considerable degree, since according to the above non-converted chlorate ions will migrate towards the anode in the subsequent electrolysis and accompany the enriched acid back to the reactor. Also, normally used catalytic ions will return to the reactor in the same way. Thus it is possible within the scope of our invention to supply to the electrolytic vessel residual solutions having an acid content of 5 N or more, but the economy of the process is improved if the solution is neutral or slightly acidic.

It should be observed that the residual solution can be neutral or slightly acidic even if the acid content in the reactor is high. The above-mentioned Rapson R-3-process produces, e.g. for preparation of chlorine dioxide, only a solid, neutral sodium sulphate in spite of a considerable acid content in the reactor, and if this sodium sulphate is to be residual solution the latter will be almost neutral.

The reducing agent is supplied to the reactor in amounts equivalent to the amount of chlorate added in batches. If the reducing agent is added in the form of sodium chloride this may be present in a content of 0.01–4 M. A chloride ion content exceeding the chlorate content by more than about twice leads to too high a degree to the side reaction discussed above, in which chlorine gas is formed instead of chlorine dioxide. If the reducing agent is sulphuric acid the content can be chosen more freely, but also in this case too large excesses of reducing agent should be avoided.

The temperature in the reactor may be anywhere between the freezing point of the reaction solution and an upper limit, which is defined by the decomposition of the chlorine dioxide and the risk of explosion and which is normally not put higher than 100° C. In order to simplify the separation of the gaseeous chlorine dioxide the higher temperatures are chosen whereas lower temperatures are used when it is desired to maintain the chlorine dioxide in the solution, e.g. for a common downward leading of chlorine dioxide and residual solution in the electrolytic cell.

The pressure in the reactor is normally atmospheric pressure, but a slight negative pressure can be applied to facilitate the evaporation of the chlorine dioxide gas or to evaporate the solution by boiling at lower temperatures. Normally inert gas is also led through the reactor to evaporate the chlorine dioxide and to hold down its partial pressure to explosion-safe values, preferably below 100 mm Hg.

Certain conditions as to the purity of the chlorine dioxide must be fulfilled to ensure proper function of the process. Generally chlorine gas is present in the chlorine dioxide gas stream leaving the reactor. This chlorine gas, as well as from this in the catholyte produced hypochloric ions, reacts with the chlorite ions to produce chlorate or chloride ions, which lowers the economy and the stability of the process. Acordingly, it is desirable that not more than 10 per cent by volume of the absorbed gases is chlorine gas and preferably not more than 5 per cent. This can be achieved e.g. by regulation or selection of proper reaction parameters, by scrubbing the product gas stream, or in other ways.

The reaction can be carried out in a tank reactor, a series of tank reactors or in a tube reactor.

The acid content of the residual solution may vary between neutral or slightly acidic and about 5 M, as mentioned above. After the variations of concentration in the reactor its content of salt can vary between 0.01 and 6 M.

The design of the electrolytic cell has been discussed above. According to the preferred embodiment the anode compartment has an acid content which is enough to provide the desired acid content there at recycling to the reactor. The pH of the catholyte is maintained between 4 and 9, since lower as well as higher values, as mentioned above, lead to side-reactions to an undesired extent. The catholyte should also have a relatively high content of chlorite to facilitate the precipitation in the evaporator 19. The solution coming from the absorption plant 22 is preferably saturated in respect to chlorine dioxide, which means about 0.01 – 1 M depending on the absorption conditions. As indicated above the chlorine dioxide can also be supplied to the cell in the form of gas, possibly through a gas electrode. The normal potential of the chlorine dioxide reduction is 0.954 V, and in the operation of the cell the voltage of the cathode should be maintained between + 0.2 and + 1 V relative to the normal hydrogen gas electrode. At lower potentials chlorite ions are reduced to chloride as a non-desired by-reaction. At higher voltages other reducing reactions than those desired may occur. The total voltage over the cell varies strongly with the operating conditions but is normally between 0.1 and 10 V. The current density on the electrode surface can vary between 0.01 and 20 A/dm$^2$.

Since chlorine dioxide and chlorite tend to form an unstable complex, which can give losses in the process, it is preferred to keep the concentration of the complex below 0.05 M by keeping at least one of the components in the complex at a low concentration everywhere in the system. It is also preferred to keep the production rate up to avoid the desintegration of the complex compounds by using a cell current of at least 10 A per dm$^3$ circulating catholyte solution.

The invention is not restricted to the embodiments and examples described above but can be varied in different ways within the scope of the following claims.

The oxygen gas from the anode compartment can e.g. be used as dilution gas in the reactor. Alternatively it can be used in future fuel cells after purification.

If residual solution and chlorine dioxide are led in common to the electrolytic cell the flow is preferably introduced into the cathode compartment of a three-compartment cell according to the drawing, after which the cathode compartment solution after chlorite enrichment is led to a stage for chlorite separation, from which the remaining solution is transferred to the intermediate compartment for working up.

EXAMPLE 1

A cell was prepared consisting of a graphite cathode, a ruthenium oxide coated titanium metal anode and therebetween a Nafion (a fluorinated hydrocarbon plastic with sulfonic acid groups as ion exchange means) cation selective membrane. Chorine dioxide gas was led into a chlorite containing solution to produce a catholyte of pH 5 containing 0.1 M $ClO_2$, 0.1 M $NaClO_2$ and 0.3 M acetate buffer. An anolyte containing 0.5 M sodium ion was prepared. During 6 hours and at a temperature of 20° C a current was led through the cell. The current density at both the anode and the cathode varied from 1.5 to 0.3 A/dm$^2$ and the cell potential varied from 0.75 to 0.06 V while the cathode potentioal was kept at + 0.75 V relative the standard hydrogen electrode. A chlorite amount corresponding to a current yield of 94 per cent was produced.

EXAMPLE 2

A cell according to example 1 was prepared. Chlorine dioxide gas was led into a clorite slution to produce a catholyte of pH 5 containing 0.2 M chlorine gas, 1.2 M $NaClO_2$ and 0.4 M acetate buffer. An anolyte containing 4 M sodium ions was also prepared. During 3 hours at a temperature of 10° C a current was led through the cell. The current density at the cathode varied from 0.6 to 0.2 A/dm$^2$ and the anode from 2.2 to 0.7 A/dm$^2$. The cell potential varied from 0.12 to 0.04 V while the cathode potential relative to standard hydrogen electrode was kept at + 0.65 V. After the electrolysis the catholyte held 0.02 M $ClO_2$ and a chlorite amount corresponding to a current yield of 83 per cent was produced.

EXAMPLE 3

A cell was prepared consisting of a ruthenium oxide coated titanium metal cathode and a platinium-titanium metal anode and therebetween a membrane according to example 1. Chlorine dioxide gas was led into a chlorite containing solution to product a catholyte of pH 5 containing 0.24 M $ClO_2$, 0.02 M $NaClO_2$ and 0.3 acetate buffer. An anolyte having a sodium ion content of 0.1 M was also prepared. During 6 hours at a temperature of 14° C current was led through the cell. The current density at the cathode and at the anode was kept at 0.54 and 0.3 A/dm$^2$ respectively. The potential of the cathode was kept at + 0.5 V relative to the standard hydrogen electrode. A catholyte contaning 0.14 M $ClO_2$ and 0.08 M $NaClO_2$ was produced, corresponding to a current yield of 92 per cent.

We claim:

1. The process which comprises (a) reacting an alkali or alkali earth metal chlorate with a reducing agent under acid conditions in a reaction zone to thereby form chlorine dioxide and a residual aqueous solution containing alkali or alkali earth metal ions, (b) providing an electrolytic cell comprising an anode, a cathode and a cation selective membrane positioned between said anode and said cathode, said electrolytic cell being separate from said reaction zone, (c) withdrawing said residual solution from said reaction zone and introducing it into said electrolytic cell on the anode side of said cation selective membrane, (d) withdrawing the chlorine dioxide formed in said reaction zone and feeding this chlorine dioxide to the cathode side of the cation selective membrane of the cell, (e) electrolytically producing hydrogen ions at said anode, (f) withdrawing from the anode side of said cation selective membrane of said cell a solution which has, in relation to said residual solution, a decreased concentration of alkali or alkali earth metal ions, (g) feeding at least a part of the solution withdrawn from the cell according to step (f) to said reaction zone, (h) electrolytically reducing the chlorine dioxide to chlorite at said cathode, and (i) withdrawing alkali or alkali metal chlorite from the cathode side of said cation selective membrane of said cell.

2. The process of claim 1 wherein the reduction of the chlorate in said reaction zone is carried out by means of a chemical reducing agent selected from the group consisting of sulphur dioxide, chloride ion and methanol.

3. The process of claim 1 wherein said electrolytic cell is divided into three compartments by means of a cation selective membrane next to the cathode and an anion selective membrane next to the anode, said residual solution withdrawn from said reaction zone is supplied between said membranes, the chlorite enriched fraction is withdrawn from the cathode compartment of said cell and the acid enriched fraction is withdrawn from the anode compartment.

4. The process according to claim 1, wherein the pH-value of the residual solution entering the electrolytic cell is between 1 and 7.

5. The process according to claim 1, wherein the pH-value of the residual solution entering the electrolytic cell is between 3 and 7.

6. The process according to claim 1, wherein not more than 10 mole percent of the chlorine dioxide containing gas is chlorine gas.

7. The process according to claim 1, wherein not more than 5 mole percent of the chlorine dioxide containing gas is chlorine gas.

* * * * *